US006276680B1

(12) United States Patent
Sonoda et al.

(10) Patent No.: US 6,276,680 B1
(45) Date of Patent: Aug. 21, 2001

(54) SHEET FEEDING APPARATUS AND RECORDING APPARATUS

(75) Inventors: Shinya Sonoda, Yokohama; Haruyuki Yanagi, Machida; Hiroyuki Tanaka, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/382,210

(22) Filed: Aug. 25, 1999

(30) Foreign Application Priority Data

Aug. 27, 1998 (JP) ..... 10-241789

(51) Int. Cl.[7] ..... B65H 5/02
(52) U.S. Cl. ..... 271/273; 271/272
(58) Field of Search ..... 271/272, 273, 271/274

(56) References Cited

U.S. PATENT DOCUMENTS 4,729,557 * 3/1988 Kiyohara ..... 271/272
5,606,357 * 2/1997 Bekki ..... 271/274
5,800,076 * 9/1998 Umeda ..... 271/274
6,007,063 * 12/1999 Park ..... 271/273
6,059,287 * 5/2000 Bae ..... 271/272
6,073,927 * 6/2000 Sako et al. ..... 271/273

FOREIGN PATENT DOCUMENTS

403243553A * 10/1991 (JP) ..... 271/273

* cited by examiner

*Primary Examiner*—H. Grant Skaggs
(74) *Attorney, Agent, or Firm*—Fitzpatrick, Cella, Harper & Scinto

(57) ABSTRACT

Present invention relates to a sheet feeding apparatus comprising a first feeding rotary body for feeding sheets, a second feeding rotary body located in facing to the first feeding rotary body for feeding the sheets between the second feeding rotary body and the first feeding rotary body upon pressing the sheets, an elastic shaft serving as a rotary center of the second feeding rotary body for urging the second feeding rotary body toward the first feeding rotary body and restricting means for restricting movements of the second feeding rotary body in multiple directions by contacting with the second feeding rotary body.

12 Claims, 11 Drawing Sheets

SHEET FEEDING APPARATUS AND RECORDING APPARATUS

BACKGROUND OF THE INVENTION

1. Field of the Invention

This invention relates to a sheet feeding apparatus for feeding sheets and, more particularly, to a sheet feeding apparatus for feeding recording media in a recording apparatus having a function such as a printer, a photocopier, a facsimile machine, or the like.

2. Description of Related Art

Recording apparatuses having a function such as a printer, a photocopier, a facsimile machine, or the like, and recording apparatuses used for output devices for hybrid electronics apparatuses such as computers and word processing apparatuses or workstations are structured to record images on recording media such as sheet papers and plastic thin plates based on image information. The recording apparatuses can be categorized, based on the recording method, into the inkjet type, the wire dot type, the thermal type, the laser beam type, or the like.

In a recording apparatus of a serial type using a serial scanning method in which a main scanning is made in a direction intersecting with a feeding direction of the recording medium (subsidiary scanning direction), the entire recording medium is recorded by repeating the processes of recording images (main scanning) by a recording means mounted on a carriage traveling along a recording medium feeding the sheet in a fixed amount (pitch feeding) after images of one line are recorded, and subsequently recording images of the next line (main scanning) on the recording medium stopped again. On the other hand, in a line type recording apparatus which does recording only in the subsidiary scanning direction, the entire recording medium is recorded by repeating the processes of setting a recording medium at a prescribed recording position. feeding the recording medium in a predetermined amount (pitch feeding) after the one line recording is made at one time, and recording the next line at one time.

FIG. 11 shows a perspective view showing a conventional inkjet recording apparatus. In the inkjet recording apparatus, the recording medium fed by a feeding apparatus 101 is held by a platen 122 constituted such that a feeding surface in the printing area is made flat and delivered by a delivery means 133 formed on a downstream side in the feeding direction after images are formed by a recording head 124.

The delivery means 133 includes a delivery roller 134, and a special paper pressing member (e.g., a spur having a gear teeth on circumferential surface) 136*d* located facing to the delivery roller 134 for feeding the recording medium in pressing the recording medium through point contacts. Rotation of those members makes the recording medium fed with applied inks not yet fixed right after printing.

The delivery roller 134 is freely rotatable where each opposite end of the shaft is attached to a bearing formed at the platen 122. A recording medium feeding portion of the roller is rounded with a material such as a rubber or sponge-like material thereby rendering the recording medium hardly slip when fed.

The drive force given to the delivery roller 134 is transmitted from a paper feeding roller 132 via a transmission roller 135 attached to the platen. The transmission roller 135 is urged as to press both of the paper feeding roller 132 and the delivery roller 134 by an elastic shaft.

The spur 136 has a circumferential portion with gear teeth, which tend not to leave pressed marks or ink marks on the recording medium, so that such a spur is widely used for an inkjet recording apparatus.

The spur 136 functions for maintaining the printing quality in suppressing cockling of the recording medium in a direction perpendicular to the feeding direction when recording is made with high recording density or high duty and for protecting the recording head 124 by avoiding contacts between the recording head 124 and the recording medium.

The spur 136 is mounted on an attachment member with the elastic shaft go that the spur can move in substantially a perpendicular direction with respect to the feeding surface for the recording medium according to the thickness of the recording medium, and the attachment member may be formed with a restricting means for restricting the movement of the elastic shaft to restrict the movement of the spur 136 in substantially the perpendicular direction. This is for suppressing the movement of the spur 136 within a predetermined distance where the recording media is fed in a multiple number from the feeding apparatus 101 (duplicated feeding) to prevent the elastic shaft as a rotary shaft of the spur 136 from receiving damages.

With the conventional inkjet recording apparatus, as described above, no restricting means is provided for restricting the movement of the spur 136, and even where such a restricting means is provided, the spur 136 is restricted by restricting the position of the elastic shaft serving as the rotary shaft of the spur 136 by means of the restricting means.

With the latter structure, however, the elastic shaft may come in contact with the restricting means where the extremely thick recording medium is fed from the feeding apparatus 101 or where multiple recording media are fed from the feeding apparatus 101, thereby exerting large shear force to the elastic shaft, and possibly damaging the elastic shaft.

Furthermore, because the restricting means for restricting the movement of the spur 136 by restricting the movement of the elastic shaft is provided only in substantially the perpendicular direction with respect to the feeding surface of the recording medium, the elastic shaft may be damaged upon exertion of shear force in a direction that the recording medium is pulled out to the elastic shaft serving as the rotary shaft of the spur 136 when, e.g., the recording medium is pulled out due to occurrence of jamming of the recording media. Therefore, it is required to make the elastic shaft itself stronger, and this requirement may result in restriction on design.

As a structure to pull out the recording medium without exerting load to the spur 136 during paper jamming, a spur 136 may be conceivably attached to a cover portion that can be opened and closed as shown in FIG. 11, but in such a case, the structure may bring higher production costs and restriction on accuracy in assembling parts.

It is an object of the invention to provide a sheet feeding apparatus capable of preventing an elastic shaft of a spur from receiving damages due to force in multiple directions exerted to the spur during paper jamming or the like.

SUMMARY OF THE INVENTION

A representative structure of the invention in order to accomplish the above objects includes a first feeding rotary body for feeding sheets, a second feeding rotary body located opposing the first feeding rotary body for feeding the sheets between the second feeding rotary body and the first feeding rotary body upon pressing the sheets, an elastic shaft serving as a rotary center of the second feeding rotary body for urging the second feeding rotary body toward the first feeding rotary body, and restricting means for restricting movements of the second feeding rotary body in multiple directions by contacting with the second feeding rotary body.

According to the above structure, since the restricting means restricts movements of the second feeding rotary body in multiple directions by contacting with the second feeding rotary body, the elastic shaft serving as a rotary shaft of the second feeding rotary body can be prevented from inflicting damages because the movable range of the second feeding rotary body can be restricted not only in a substantially perpendicular direction with respect to the sheet feeding surface but also during a paper jamming, by, e.g., restricting the movements of the second feeding rotary body in a sheet thickness direction and in a direction toward an upstream side in the sheet feeding direction by means of the restricting means.

The second feeding rotary body is made of a tooth portion for feeding the sheets by pressing the sheets at point contacts to the sheets and a disc portion not in contact with the sheets, and the restricting means contacts with an outer round surface of the disc portion of the second feeding rotary body to restrict the movements. By such a structure, the second feeding rotary body contacts with the restricting means through larger contact areas, thereby further enhancing the above advantages.

Where the restricting means has at least one curving surface formed with a radius substantially the same length as a radius of an outer diameter portion of the disc portion of the second feeding rotary body, the outer diameter portion of the disc portion of the second feeding rotary body can suffer only from minimum damages due to contacts between the second feeding rotary body and the restricting means.

Where the restricting means is formed at a positioning member formed at a support member rotatively supporting the elastic shaft for positioning the body in an insertion direction of the elastic shaft, a number of parts can be reduced, so that a step number of the assembling process as well as production costs can be expectedly reduced.

Where a rib-shaped wall is formed in a range wider than the outer shape of the second feeding rotary body including the movable portion of the second feeding rotary body to the support member supporting the second feeding rotary body so that the elastic shaft is rotatable, the second feeding rotary body may not project outside from the contour of the rib-shaped wall during paper jamming or the like.

Moreover, for example, as a feeding means for feeding a recording medium on a downstream side of a recording means for recording images on a sheet as such as a recording medium, a structure in a recording apparatus having the above sheet feeding apparatus is so made that the support member for supporting the second feeding rotary body in a way that the elastic shaft is rotatable is molded in a united body with a platen for supporting a recording medium at a recording section in facing with the recording means, so that the steps of the assembling process and production costs can be expected in reducing the number of the parts.

The size deviations of the platen, the bearing of the first feeding rotary body, and the positioning member of the second rotary body can be managed within the same part, so that the pressure of the second feeding rotary body to the sheets can be set finely, and so that the sheets or recording media can be conveyed stably.

DETAILED DESCRIPTION OF PREFERRED EMBODIMENTS

Hereinafter, preferred embodiments of sheet feeding apparatuses to which this invention applies are described in detail. It is to be noted that in the embodiments below, sheet feeding apparatuses used for recording apparatuses are described as examples.

[First Embodiment]

Figure 1:
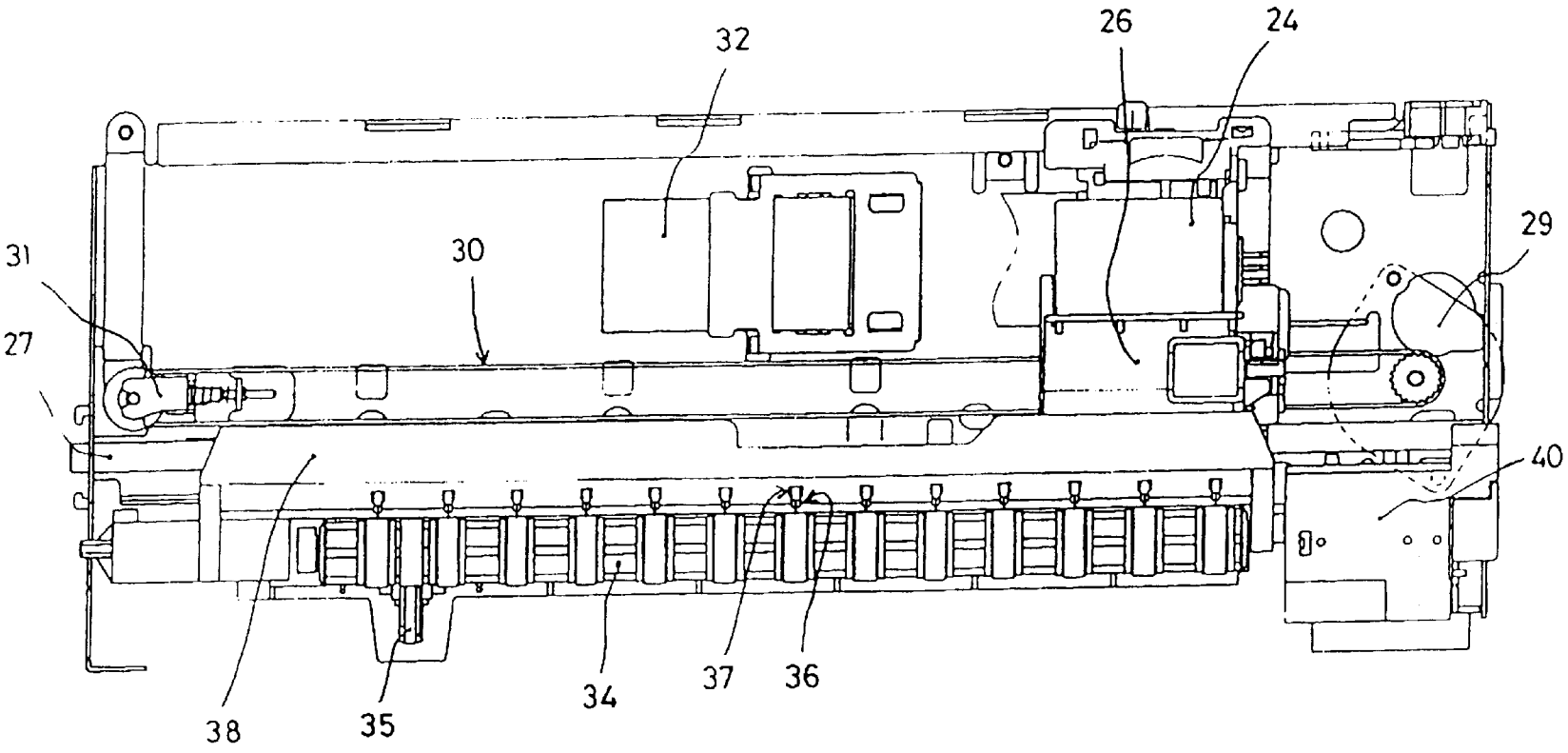
FIG. 1 is a front view showing a schematic structure of a recording apparatus according to a first embodiment.
Figure 2:
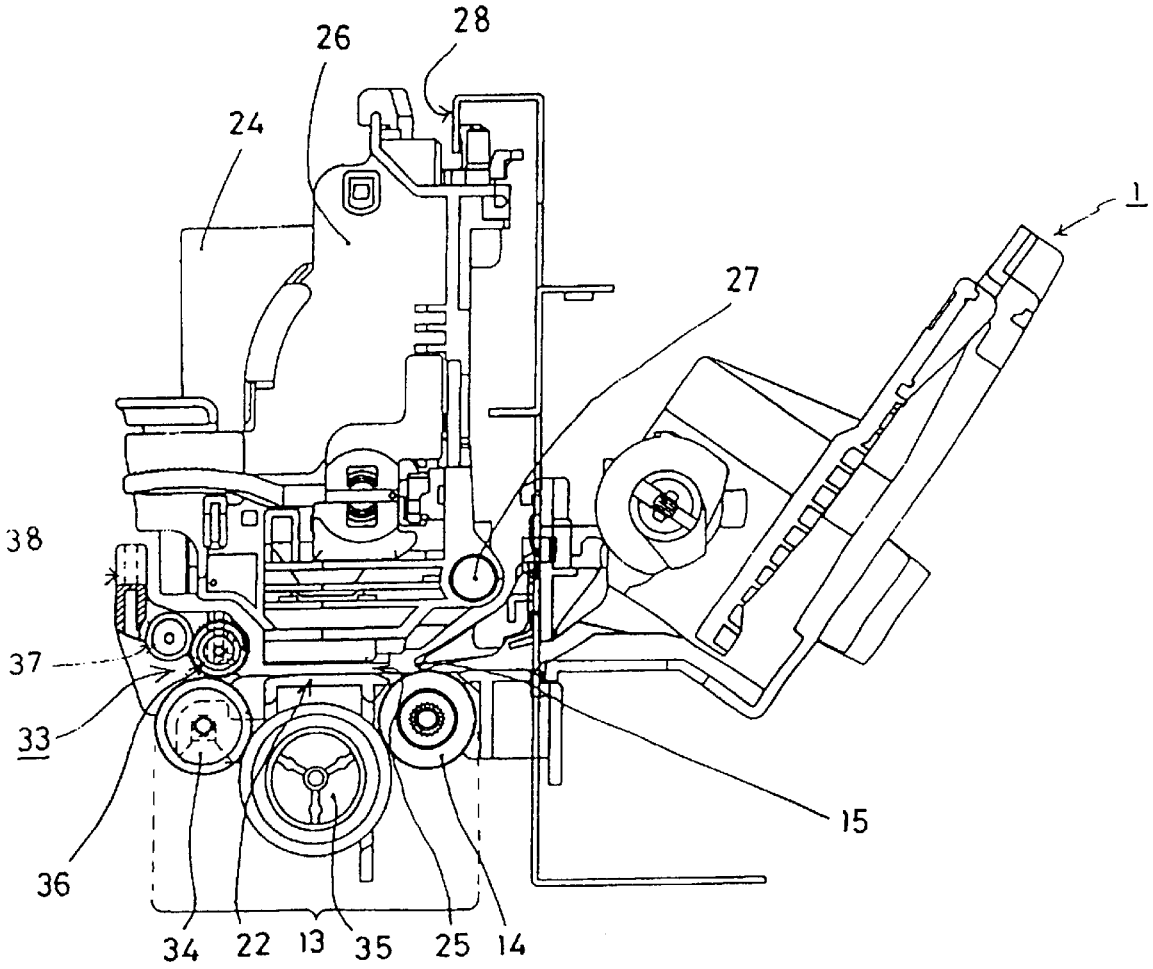
FIG. 2 is a cross section showing the recording apparatus according to the first embodiment.
Figure 3:
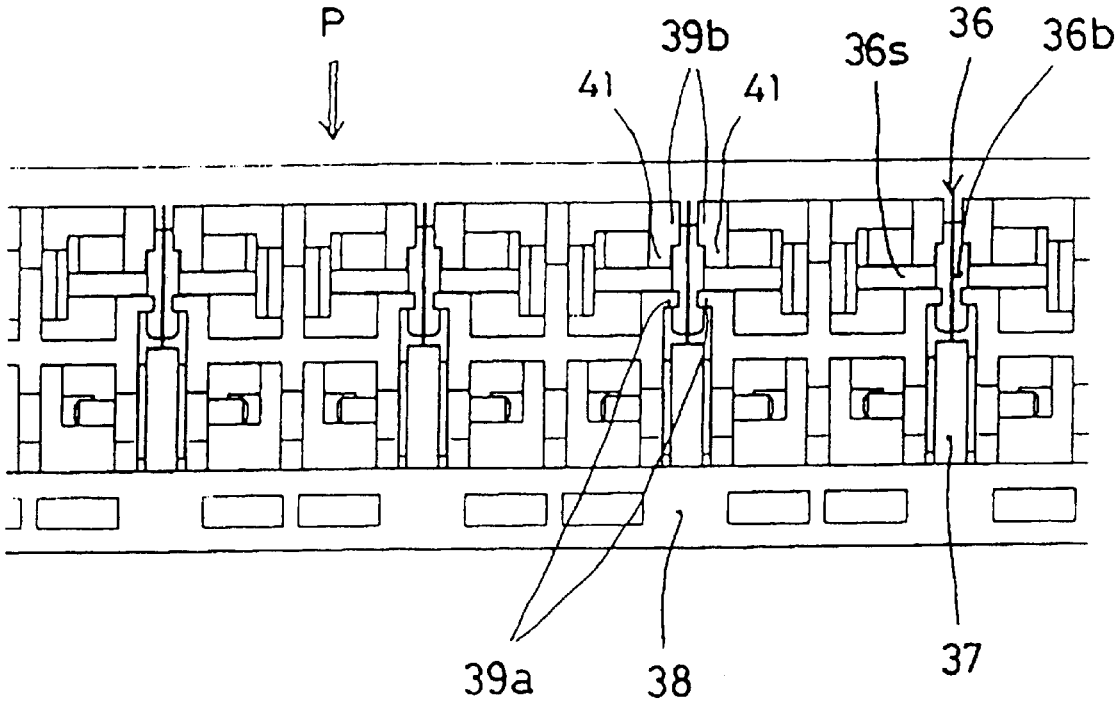
FIG. 3 is a top view showing a spur stay provided at a delivery section of the recording apparatus according to the first embodiment.
Figure 4:
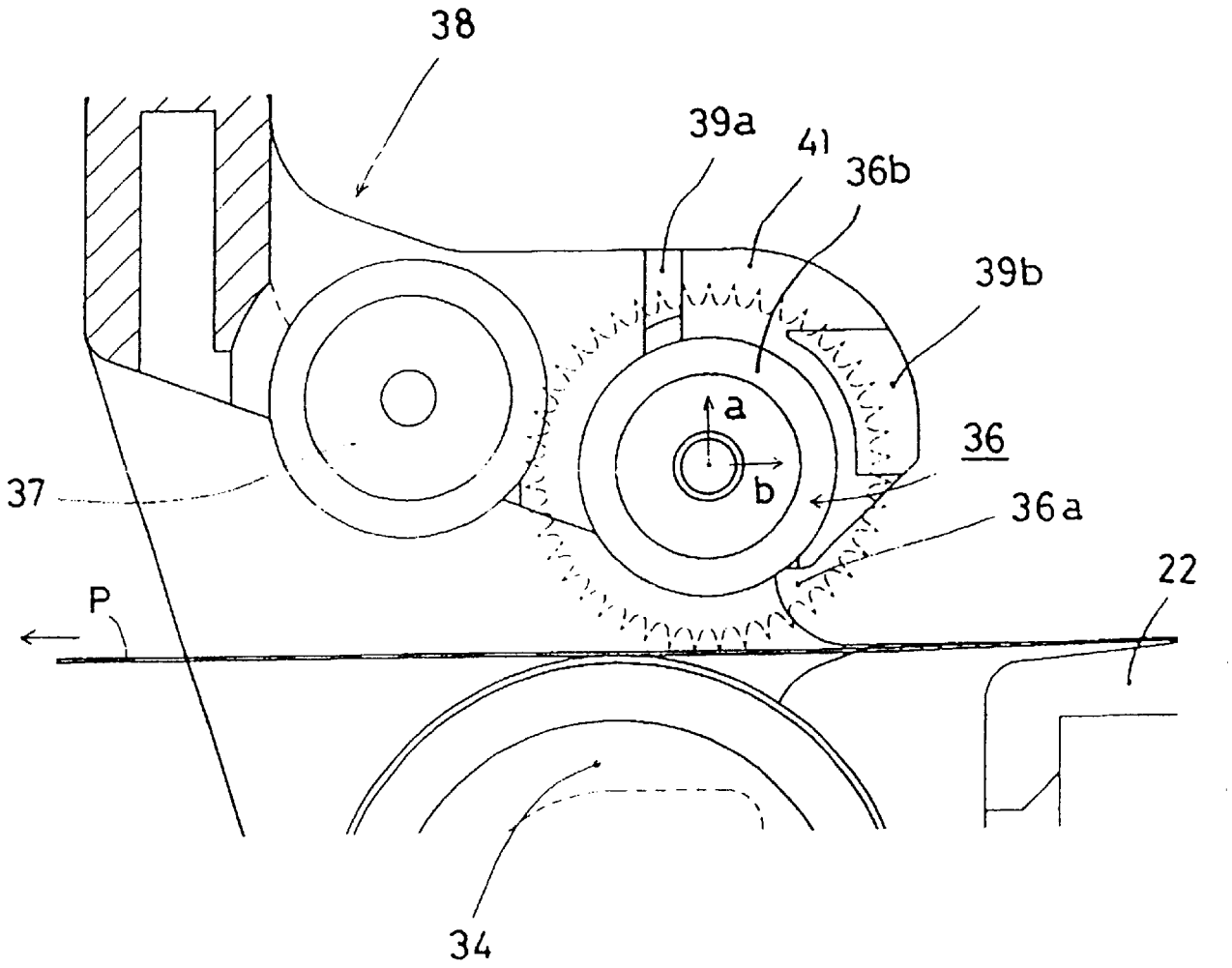
FIG. 4 is an enlarged cross section showing a delivery section (when a sheet is fed) of the recording apparatus of the first embodiment.
Figure 5:
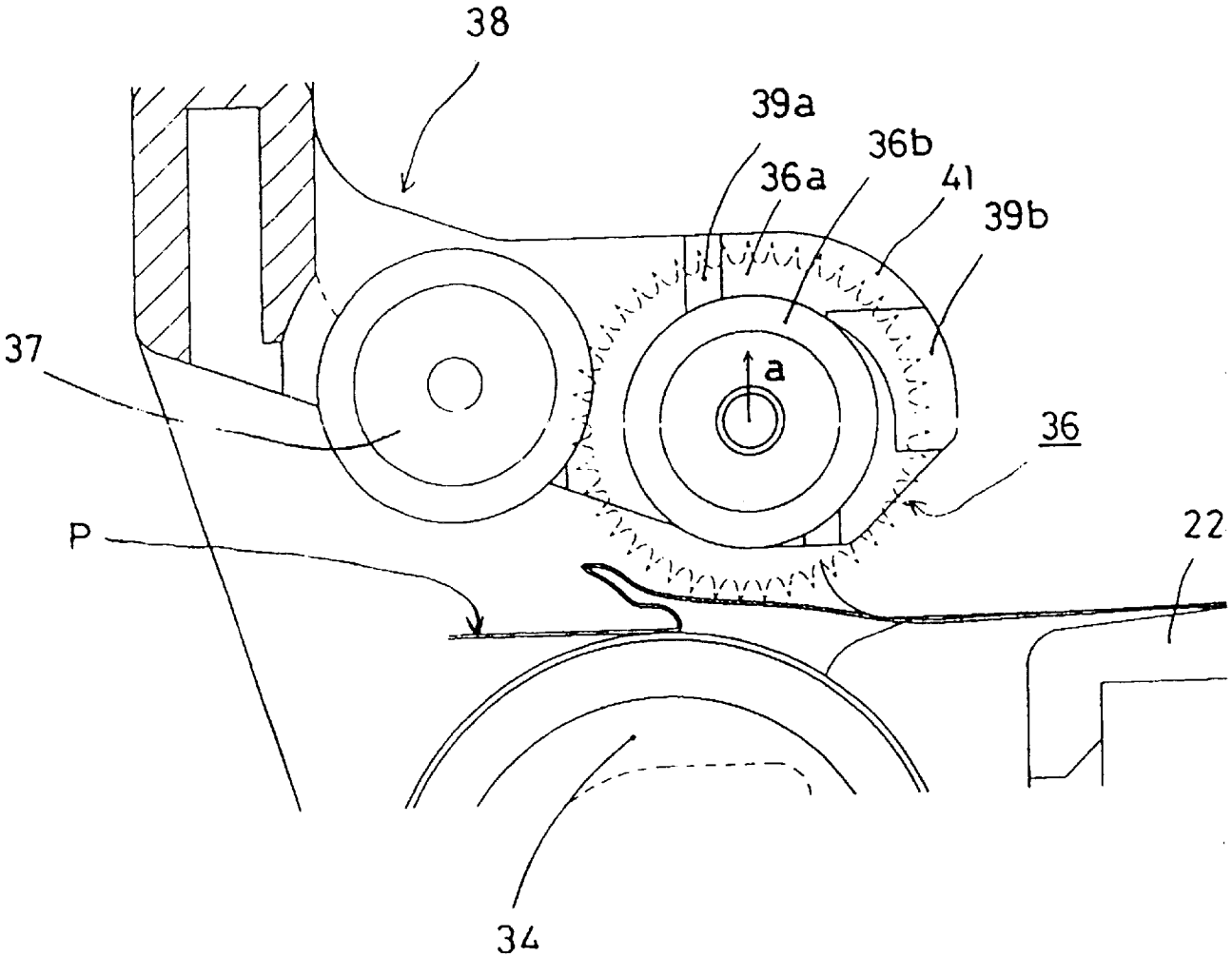
FIG. 5 is an enlarged cross section showing a delivery section (when a sheet is jammed) of the recording apparatus of the first embodiment.
Figure 6:
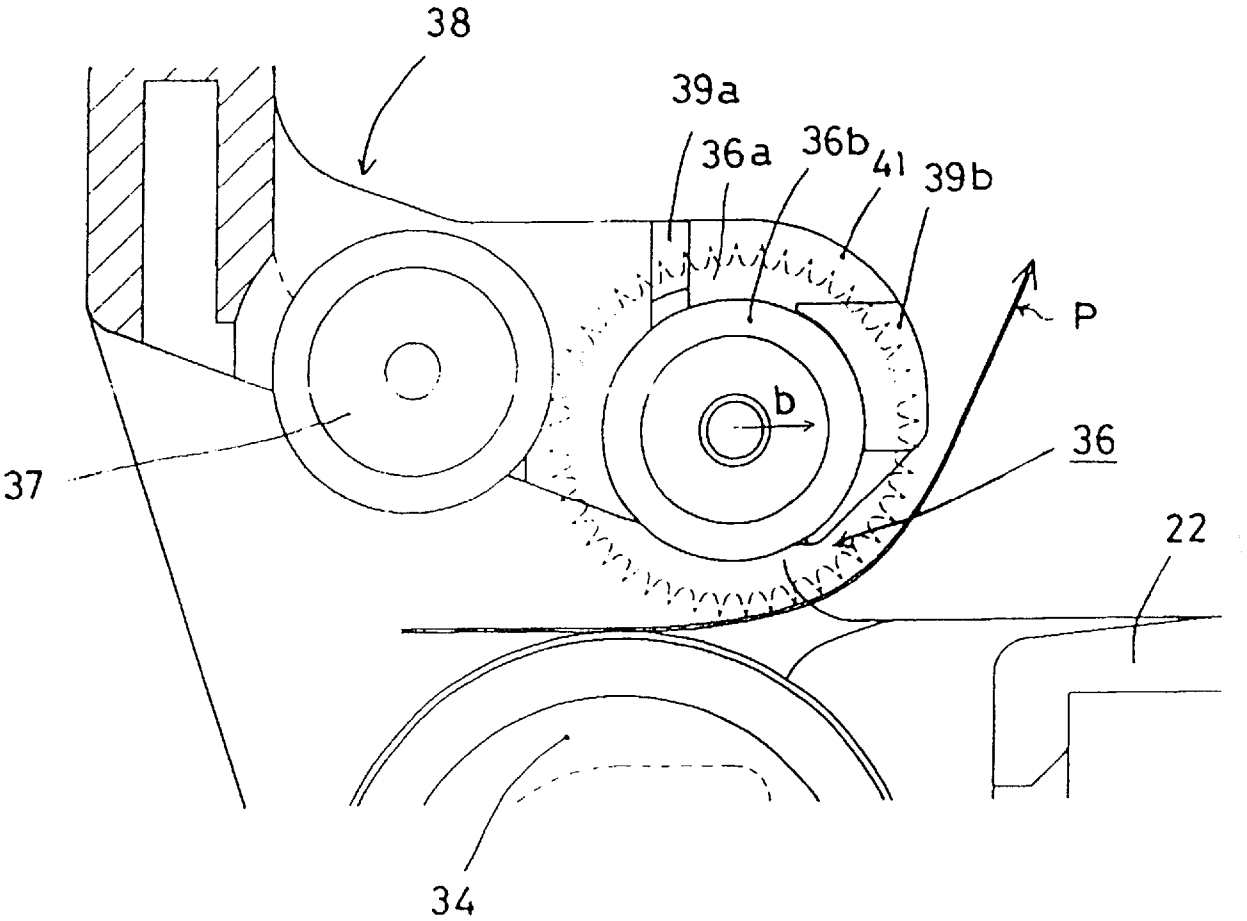
FIG. 6 is an enlarged cross section showing a delivery section (when a sheet is pulled out) of the recording apparatus of the first embodiment.

Referring to FIGS. 1 to 6, a recording apparatus having a sheet feeding apparatus according to the first embodiment is described. In this embodiment. an inkjet recording apparatus is described. FIG. 1 is a front view showing a schematic structure of an inkjet recording apparatus according to a first embodiment; FIG. 2 is a cross section showing the inkjet recording apparatus; FIG. 3 is a top view showing a spur stay provided at a delivery section of the inkjet recording apparatus; FIGS. 4 to 6 are enlarged cross sections showing a delivery section of the inkjet recording apparatus.

The inkjet recording apparatus illustrated in this embodiment is a recording apparatus having a recording medium (hereinafter referred to as "sheet") feeding apparatus as a united body, and has a sheet feeding apparatus 1, a paper feeding section 13, a delivery section 33, a recording section 25, a cleaning section 40, and so on. Those structures are described below.

First, the structure of the sheet feeding apparatus 1 is described. The sheet feeding apparatus 1 is attached to an apparatus body in having a prescribed angle (about 30 to 60° in this embodiment) as shown in FIG. 2, and the sheets P having set are to be delivered substantially horizontally after recorded.

The recording head 24 is for recording images such as letters or the like made of inks on the sheet P, which is fed by a paper feeding roller 14 and a pinch roller 15 constituting the paper feeding section 13. In this apparatus, as a recording means, an inkjet recording method in which a recording head sprays ink to record images is used. That is, the recording head has fine liquid outlets (orifices), liquid passages, energy operation portions formed at a part of each liquid passage, and energy generating means for generating energy for forming droplets to operate to the liquid in the energy operation portion.

The recording section 25 includes, as shown in FIG. 1 and FIG. 2, a carriage 26 for mounting the recording head 24, a guide shaft 27 for reciprocally scanning the carriage 26 in a direction perpendicular to the sheet feeding direction, a guide 28 for maintaining a distance between the recording head 24 and the sheet P in holding the rear end of the carriage 26, a timing belt 30 for transmitting drive of a carriage motor 29 to the carriage 26, an idle pulley 31 for tensioning the timing belt 30, a flexible substrate 32 for transmitting head drive signals from an electric board to the recording head 24, and the like. The recording head 24 according to this embodiment is a recording head structured unitedly with an ink tank and can be replaced. The recording head 24 records images such as letters or the like by inks on sheets P conveyed over the platen 22.

The cleaning section 40 includes, as shown in FIG. 1, a pump, not shown., for cleaning the recording head 24, a cap, not shown, for suppressing drying of the recording head 24, a drive switching arm, not shown, for switching the drive from the paper feeding roller 14 between the sheet feeding apparatus 1 and the pump, and the like.

The delivery section 33 includes, as shown in FIG. 2 and FIG. 3, a delivery roller 34 serving as a first feeding rotary body, a transmission roller 35 for transmitting drive of the paper feeding roller 14 to the delivery roller 34, a plurality of spurs 36 serving as a second feeding rotary body located in facing to the delivery roller 34 for feeding the sheets upon pressing in point contacts with sheets, a plurality of spur cleaners 37 for absorbing the inks attached on the spur 36, and so on. The delivery roller 34 and the spurs 36 make delivery of the sheets without messing the recording surfaces of the sheets after recording. In this embodiment, the spur 36 is mounted, so as to be rotatable around an elastic shaft 36*s*, on a spur stay 38 serving as a support member, and the pressure to the sheets P is generated by the elastic shaft 36*s*.

In the delivery section 33, the delivery roller 34 is constituted of a single shaft, and the drive for the roller 34 is given from the paper feeding roller 34 in the paper feeding section 13 through the transmission roller 35. The transmission roller 35 is made in pressured contact with a drive force receiving section of the delivery roller 34 by means of an elastic shaft, not shown.

The spur 36 herein is constituted to have small contact areas in contact with the sheets and not to mess the recorded images on the sheets even where contacting to the sheet surfaces after recording is made, In this embodiment, as shown in FIG. 4 to FIG. 6, there exemplifies the spur 36 including a tooth portion 36*a* for feeding sheets in pressured point contacts with the sheets and a molded portion 36*b* in a disc shape not in contact with the sheets.

The spur 36 is so formed, as shown in FIG. 4 to FIG. 6, that the outer diameter of the disc shape molded portion 36*b* has a smaller outer diameter than the outer diameter of the tooth portion 36*a*. The spur 36 is formed with a shaft hole, not shown, for passing the elastic shaft 36*s* in the disc shaped molded portion 36*b*. This structure easily ensures the elastic shaft 36*s* and the spur 36 to slide.

Referring to FIG. 4 to FIG. 6, states of the delivery section 33 when the sheet is fed, when the sheet is jammed, and when the sheet is pulled out, are described in detail next. FIG. 4 shows a normal sheet feeding state; FIG. 5 shows a sheet jamming state; FIG. 6 shows a state when the sheet is pulled out on an upstream side in the sheet feeding direction. In each drawing, the tooth portion 36*a* of the spur 36 is shown by a broken line for illustrative purpose though it should have been shown by a solid line.

As shown in FIG. 4 to FIG. 6, restricting means 39*a*, 39*b* for restricting movements of the spur 36 in multiple directions are provided at the spur stay 38. In this embodiment, the restricting means 39*a*, 39*b* are formed on a positioning rib 41 in an insertion direction of the elastic shaft 36*s* molded unitedly as to extend from the spur stay 38.

In this embodiment, the restricting means 39*a* is constituted of a curving surface formed with a radius substantially the same as that of the molded portion 36*b* of the spur 36,and the restricting means 39*b* is constituted of two surfaces, a curving surface formed with a radius substantially the same as that of the molded portion 36*b* of the spur 36 and a vertical surface.

As shown in FIG. 4, the restricting means 39*a*, 39*b* are arranged at positions not in contact with the molded portion 36*b* of the spur 36 when the sheet P is fed where nipped by the delivery roller 34 and the spur 36.

If the sheet P is jammed at the delivery section 33, the jammed sheet P as shown in FIG. 5 pushes up the spur 36 in arrow a direction. The molded portion 36*b* of the spur 36 at that time comes in contact with the restricting means 39*a*, 39*b*, thereby restricting the movements of the spur 36. Therefore, the spur 36 cannot move any more in arrow a direction.

When the sheet P is pulled out on the upstream side in the sheet feeding direction from the delivery section 33, the spur 36 is moved in arrow b direction as the upstream side in the sheet feeding direction from the normal position shown in FIG. 4 by pulling force given to the sheet P. The molded portion 36*b* of the spur 36 at that time comes in contact with the restricting means 39*b*, thereby restricting the movements of the spur 36. Therefore, the spur 36 cannot move any more in arrow b direction (the upstream side in the sheet feeding direction).

As described above, the restricting means 39*a*, 39*b* receive the molded portion 36 of the spur 36 to restrict the movements of the spur 36 in the multiple directions (in arrow a, b directions in FIG. 4 to FIG. 6), and therefore, the elastic shaft 36*s* serving as a rotary shaft of the spur 36 may not receive shear force which otherwise causes damages on the shaft even where jamming recovery or the like causes undue force exerted to the spur 36, In this embodiment, as shown in FIG. 4 to FIG. 6, the positioning rib 41 serving as a rib-shaped wall formed unitedly with the spur stay 38 described above has a wider side shape than a movable maximum range of the tooth portion 36*a* of the spur 36. This structure prevents the tooth portion 36*a* of the spur 36 from projecting outside the contour of the rib 41 even where the molded portion 36*b* of the spur 36 hits the restricting means 39*a* or the restricting means 39*b*.

[Second Embodiment]

A sheet feeding apparatus according to the second embodiment is described in detail. It is to be noted that because the structural outline of the entire apparatus is substantially the same as that in the above embodiment, detailed descriptions are omitted. Hereinafter, the features of the sheet feeding apparatus according to this embodiment is described in detail. The members having the same functions as those in the above embodiment are described using the same reference numbers.

Although in the first embodiment the spur stay 38 is exemplified as a member separated from the platen 22, the spur stay 38 in this embodiment is formed in a united body with the platen 22. Other structures are substantially the same as those in the first embodiment. With this structure, the size deviation of the platen 22, the bearing of the delivery roller 34, and the positioning portion of the spur 36 can be managed as within the same part (a unitedly molded member of the spur stay 38 and the platen 22), so that the pressure of the spur 38 to the sheet P can be set finely, and so that the sheets P can be delivered stably. Furthermore, such a molding to form those members in a united body expectedly makes production costs reduced.

[Third Embodiment]

Referring to FIGS. 7 to 10, a sheet feeding apparatus according to the third embodiment is described in detail. FIGS. 7 to 10 are enlarged views of the essential portion of the sheet feeding apparatus (delivery section) according to the embodiment. It is to be noted that because the structural outline of the entire apparatus is substantially the same as that in the above embodiment, detailed descriptions are omitted. Hereinafter, the features of the sheet feeding apparatus according to this embodiment is described in detail. The members having the same functions as those in the above embodiment are described using the same reference numbers.

In the first embodiment, the restricting directions against the spur by the restricting means are the two directions (arrow a, b directions in FIGS. 4 to 6), but in this embodiment the restricting directions are three directions (arrow a, b, c directions shown in FIG. 7 to FIG. 10).

With respect to the restricting means according to this embodiment, one restricting means 39*a*' is comprised of three surfaces: two curving surfaces formed with a radius substantially the same as that of the molded portion 36*b* of the spur 36, and a vertical surface. The other restricting means 39*b* has the same shape as that in the above first embodiment. Other structural elements are substantially the same as those in the first embodiment except that no spur cleaner 37 is provided.

Figure 7:
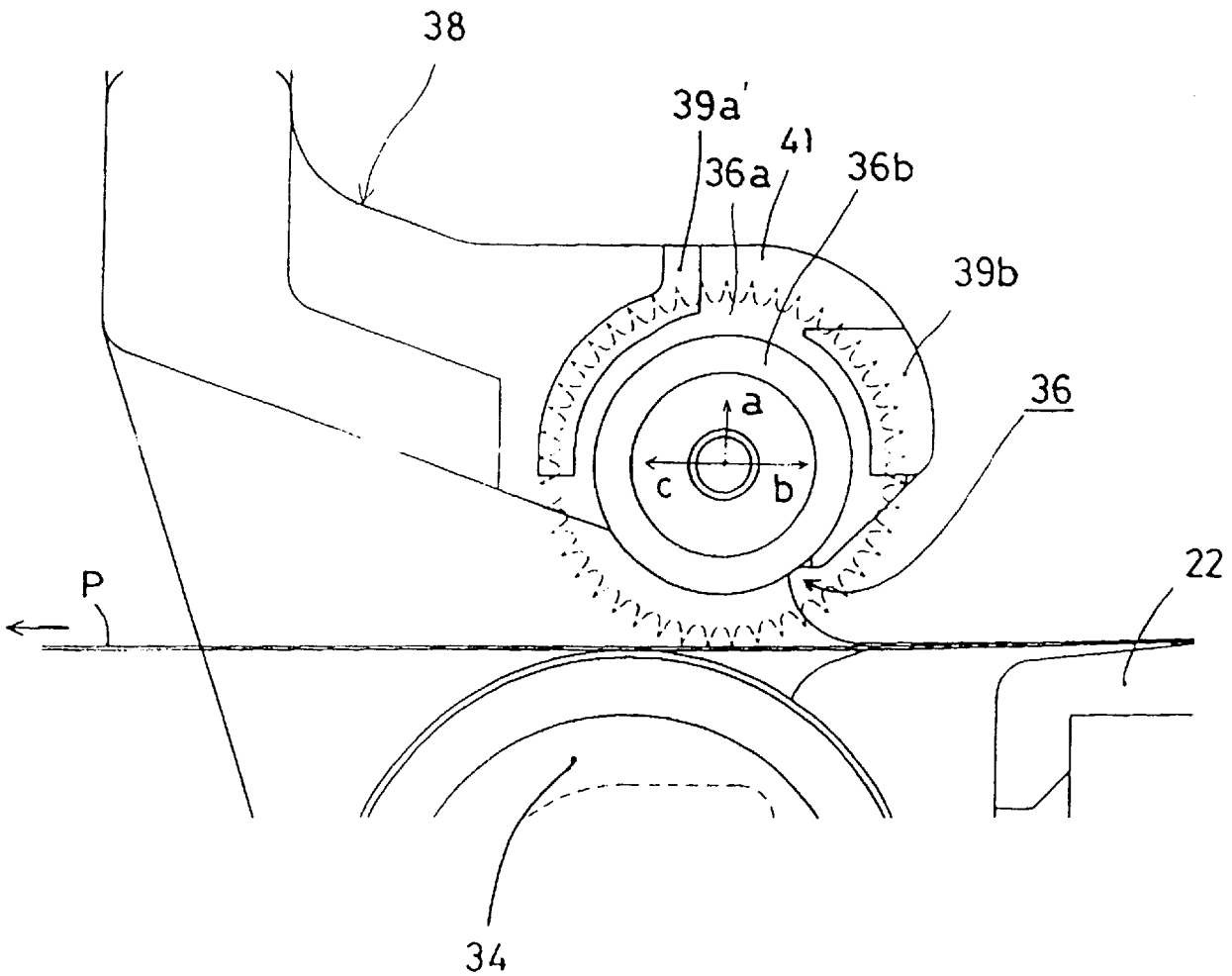
FIG. 7 is an enlarged cross section showing a delivery section (when a sheet is fed) of the recording apparatus of the third embodiment.
Figure 8:
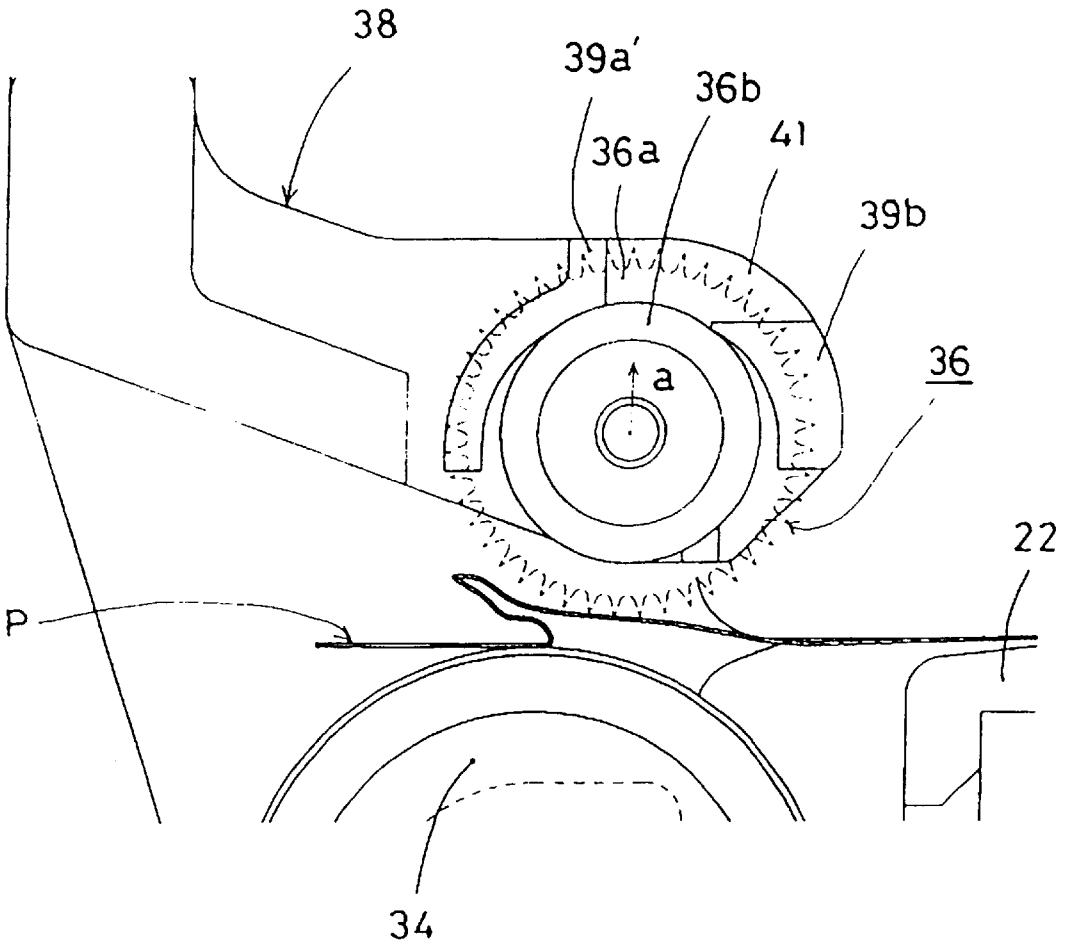
FIG. 8 is an enlarged cross section showing a delivery section (when a sheet is jammed) of the recording apparatus of the third embodiment.
Figure 9:
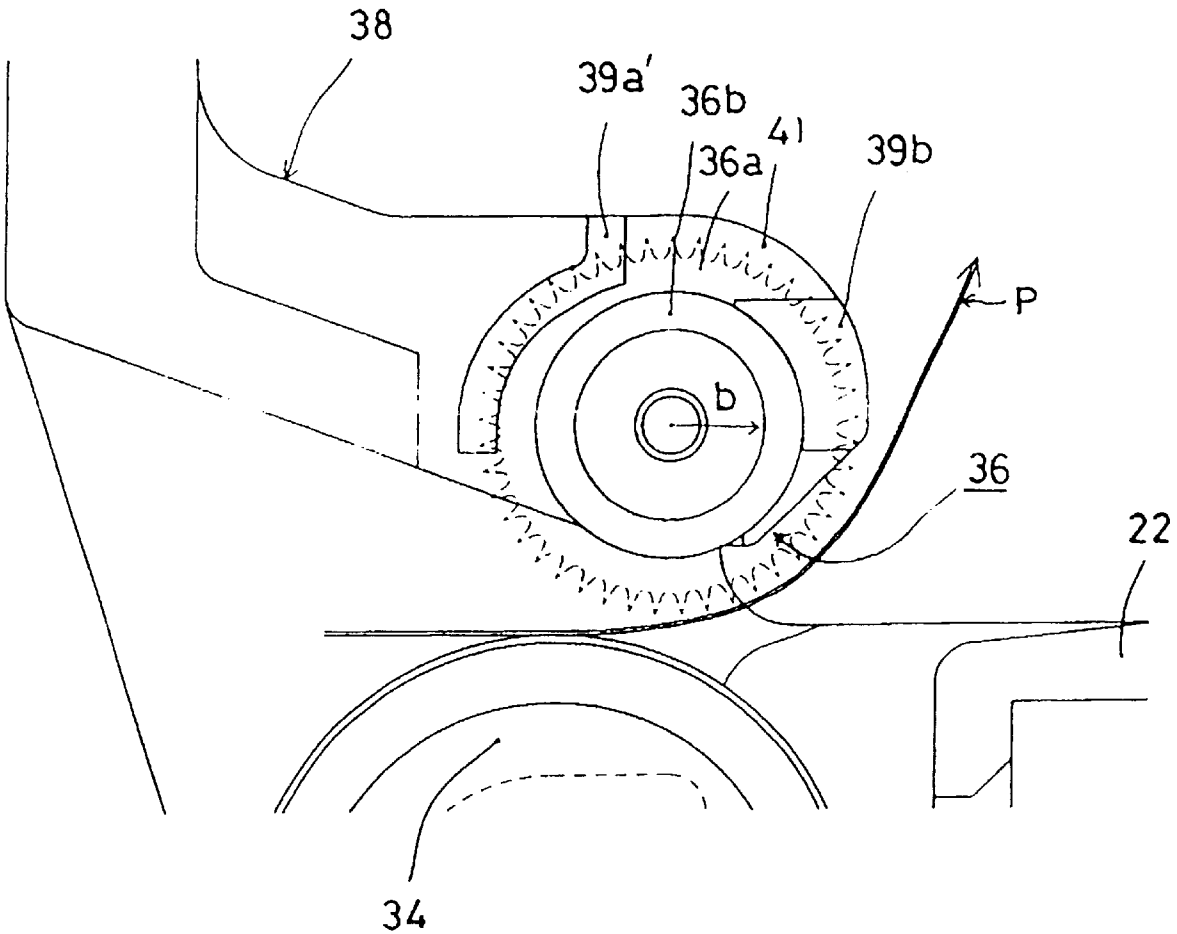
FIG. 9 is an enlarged cross section showing a delivery section (when a sheet is pulled out on an upstream side) of the recording apparatus of the third embodiment.

FIG. 7 shows a state of the normal sheet feeding of the delivery section 33; FIG. 8 shows a state where the sheet is jammed at the delivery section 33; FIG. 9 shows a state where the sheet is pulled out on the upstream side in the sheet feeding direction (arrow b direction in FIG. 9) from the delivery section 33. The effects and advantages of each state are the same as those in the first embodiment as described above.

Figure 10:
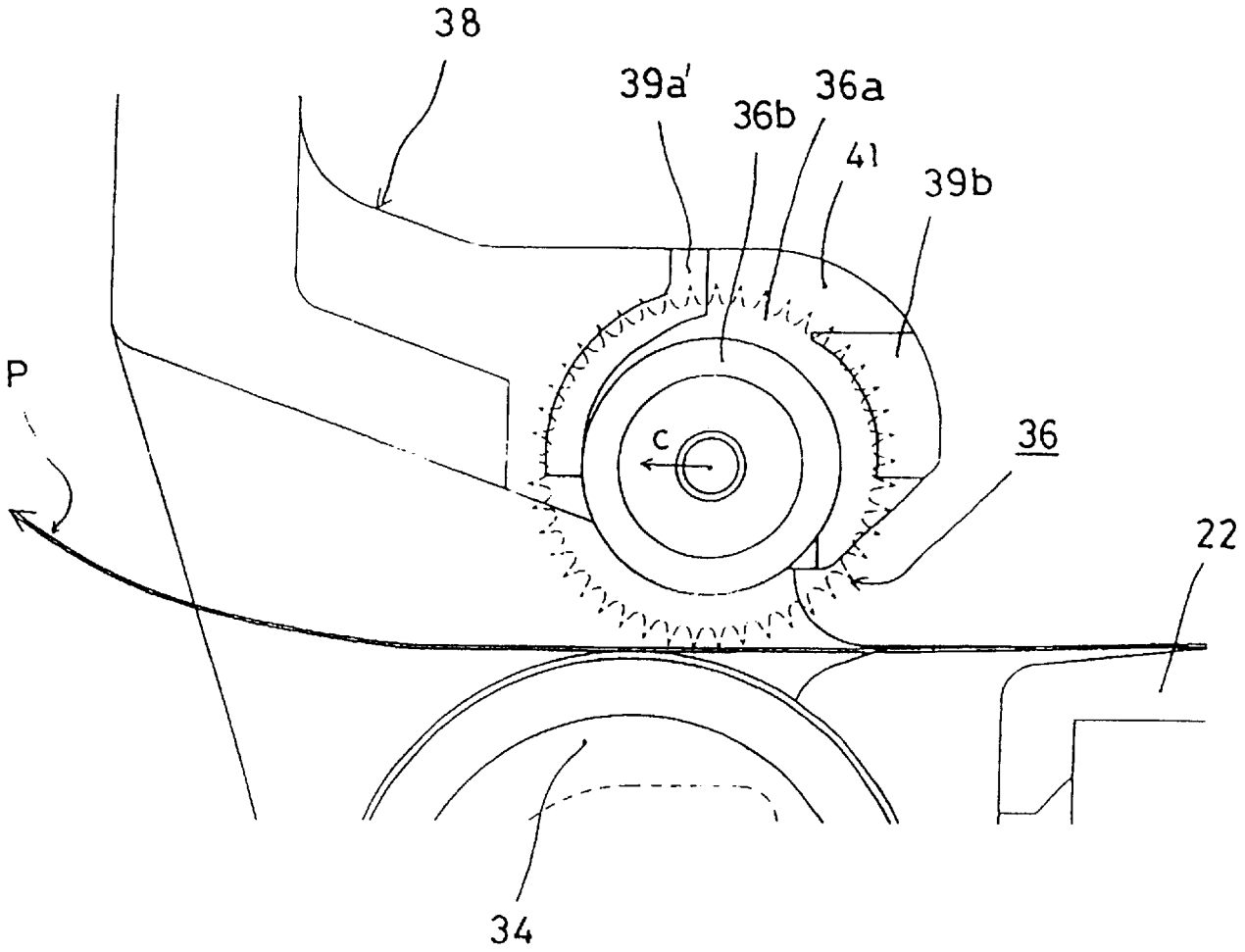
FIG. 10 is an enlarged cross section showing a delivery section (when a sheet is pulled out on a downstream side) of the recording apparatus of the third embodiment.
Figure 11:
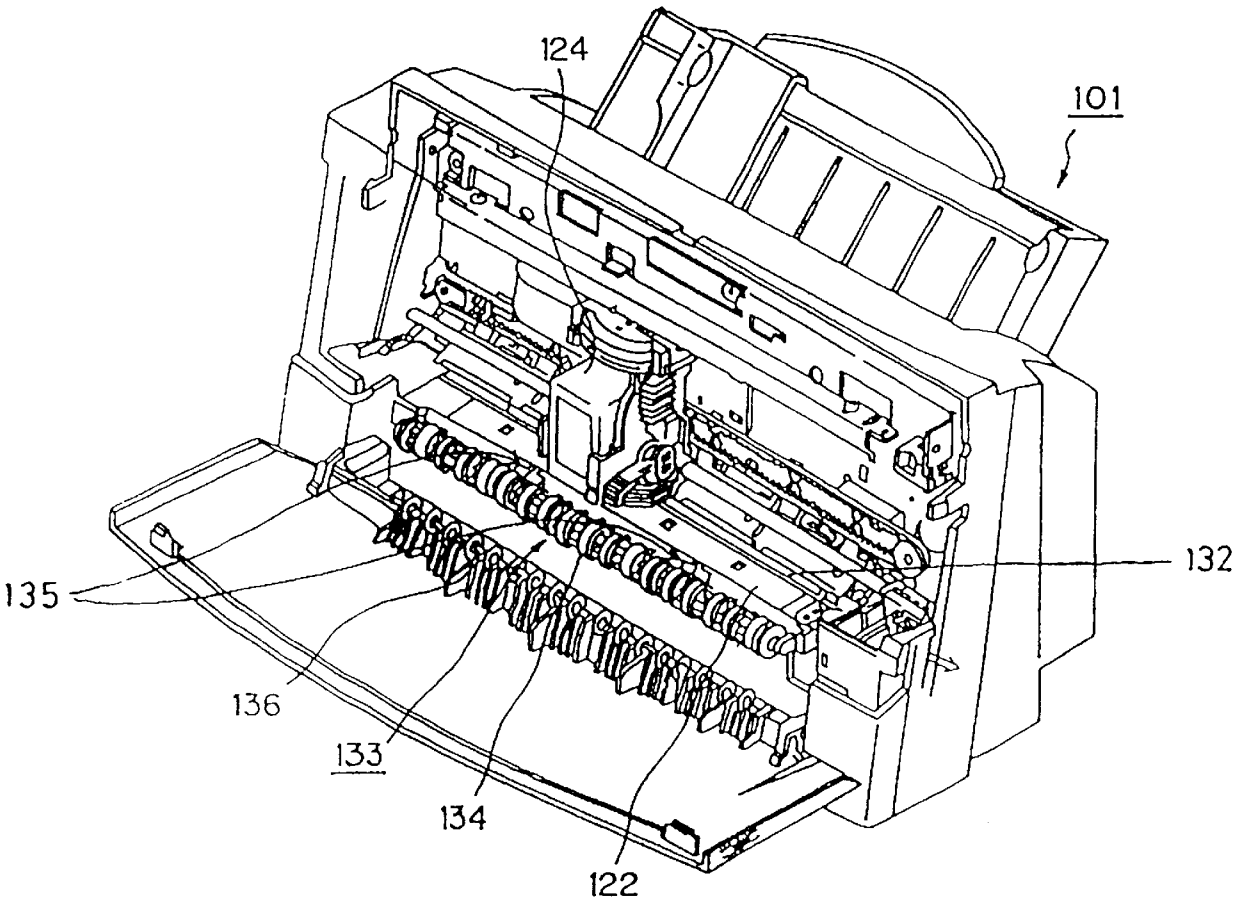
FIG.11 (Prior Art)
FIG. 11 is a perspective view showing a conventional recording apparatus.

FIG. 10 shows a state where the sheet is pulled out on the downstream side in the sheet feeding direction (arrow c direction in FIG. 9) from the delivery section 33. In such a situation, the spur 36 is moved in arrow c direction as the downstream side in the sheet feeding direction from the normal position shown in FIG. 7 by pulling force given to the sheet P. The molded portion 36*b* of the spur 36 at that time comes in contact with the restricting means 39*a*', thereby restricting the movements of the spur 36. Therefore, the spur 36 cannot move any more in arrow c direction (the downstream side in the sheet feeding direction).

With this structure, the possibility that the elastic shaft inflicts damages is further reduced, and the flexibility to design the delivery section (sheet feeding apparatus) can be made higher.

[Other Embodiments]

In the above embodiments, exemplified are the deliver roller for feeding sheets serving as the first feeding rotary body and spurs for feeding sheets in pressing the sheets located in opposed relation to the delivery roller serving as the second feeding rotary body. This invention is not limited to those figures, and substantially the same effects can be obtained in application of this invention to an apparatus having a structure that a paper feeding roller for feeding the sheets to a recording means is a first feeding rotary body and that a pinch roller for feeding the sheets in pressing the sheets located in facing to the paper feeding roller is a second feeding rotary body.

In addition that the support member for supporting the spurs rotatively can be made of a molded part entirely as described in the above embodiment, any structure can be used such that where a spur stay may be formed by a sheet metal processing, a molded support member is fitted to the stay, or all members can be made by a sheet metal processing.

Although in the above embodiments the sheet feeding apparatus for feeding sheets (recording media) such as recording paper or the like as an item to be recorded is exemplified, the invention is not limited to this, and for example, the same advantages can be obtained where this invention applies to a sheet feeding apparatus for feeding sheet such as original documents as an item to be read.

Although in the above embodiments the inkjet recording apparatus using a single recording head is exemplified and described, this invention is not limited to this, and for example, this invention is applicable, notwithstanding the number of the recording heads, to, e.g., an inkjet recording apparatus for color recording using plural recording heads for making records with different colors, or an inkjet recording apparatus for grayscale recording using plural recording heads for recording with inks of the same color but different concentrations, thereby bringing substantially the same effects and advantages.

As a recording means (recording head), any structure or combination of the recording means and the ink tank, e.g., a cartridge type in which a recording head and an ink tank are formed unitedly, a structure in which a recording head and an ink tank are formed as separate bodies which are connected with each other through an ink supply tube, or the like can be applicable in the same way as the above, and substantially the same effects and advantages can be obtained.

When this invention applies to an inkjet recording apparatus, this invention is applicable to an apparatus using a recording means using an electromechanical converter or the like such as piezoelectric devices. This invention, inter alia, brings excellent advantages to an inkjet recording apparatus using a recording means of a type that sprays ink by utilizing thermal energy. According to this type, recording can be made with high definition and high density.

This invention is applicable effectively to a recording head of a full line type having a length corresponding to the maximum width of the recording medium that can be recorded by the recording apparatus. As a recording head used for such purposes, the head can be structured by a combination of plural recording heads as to fill the length or a single recording head formed unitedly. In addition, this invention is advantageous in using a recording head secured to an apparatus body, even though it is a serial type, a recording head of a chip type that can be replaced in which the electric connection to the apparatus body and ink supply from the apparatus body can be made upon attachment onto the apparatus body, or a recording head of a cartridge type in which a recording head itself is formed unitedly with an ink tank.

It is favorable to add recovery means for a recording head and preliminary and auxiliary means, which are formed as a structure of the recording apparatus of the invention, because the advantages of the invention can be obtained further stably. Such means are, e.g., a capping means for the recording head, a cleaning means, a pressing means, and absorbing means, preliminarily heating means made of thermoelectric converters or other heating devices or combinations of those. It is also effective to do a preliminary spraying mode for spraying inks in a different way from the recording for making recording stable.

The kind and number of the recording heads carried by a carriage can be, c.g., single in corresponding to a monochrome ink, or plural in corresponding to multiple inks having different colors and concentrations. That is, as a recording mode for the recording apparatus, this invention is applicable to an apparatus capable of use of not only a recording mode only of a major color such as a black color or the like but also at least one of multicolor made of different colors, full color made by mixing colors, which are created by a recording head of a combination of plural unitedly formed heads or other means.

In addition, as a feature of the above described inkjet recording apparatus, it can be an image output terminal apparatus such as an information processing apparatus such as a computer, an inkjet input and output apparatus capable of mounting a scanner or the like other than the recording head, a photocopier in combination with a reader or the like, a facsimile machine having a transmission function, and so on.

Although in the above embodiment, an inkjet recording method is exemplified as the recording method, this invention is not limited to this, and this invention is applicable to other recording methods such as a thermal transfer recording method, a thermal sensitive recording method, an impact recording method such as a wire dot recording method, and other electrophotographic methods.

As described above, according to the invention, because the restricting means is structured to restrict the movements of the second feeding rotary body in the multiple directions by contacting with the second feeding rotary body, for example, to restrict the movements of the second feeding rotary body in the sheet thickness direction and in the direction on the upstream side in the sheet feeding direction, the elastic shaft serving as a rotary shaft of the second feeding rotary body can be prevented from inflicting damages where the movable range of the second feeding rotary body is restricted not only in a direction substantially perpendicular to the sheet feeding surface but also during paper jamming. Furthermore, the design flexibility can be improved where such an apparatus is designed.

What is claimed is:

1. A sheet feeding apparatus comprising:

a first feeding rotary body for feeding sheets;

a second feeding rotary body located in facing to the first feeding rotary body for feeding the sheets between the second feeding rotary body and the first feeding rotary body upon pressing the sheets;

an elastic shaft serving as a rotary center of the second feeding rotary body for urging the second feeding rotary body toward the first feeding rotary body; and restricting means for restricting movements of the second feeding rotary body in multiple directions when contacting with the second feeding rotary body and allowing movement of a certain distance of the second feeding rotary body when in its normal state and out of contact with the second feeding rotary body.

2. The sheet feeding apparatus according to claim 1, wherein the restricting means restricts the movements of the second feeding rotary body in a sheet thickness direction and in a direction toward an upstream side of the sheet feeding direction.

3. The sheet feeding apparatus according to claim 1, wherein the second feeding rotary body includes a tooth portion for feeding the sheets by point contacts to press the sheets and a disc portion out of contact with the sheets, and wherein the restricting means restricts the movements of the second feeding rotary body by contacting with an outer round surface of the disc portion of the second feeding rotary body.

4. The sheet feeding apparatus according to claim 3, wherein the restricting means has at least one curving surface formed with a radius substantially the same length as a radius of an outer diameter of the disc portion of the second feeding rotary body.

5. The sheet feeding apparatus according to claim 3, wherein the second feeding rotary body has an outer diameter of the disc portion which is smaller than an outer diameter of the tooth portion.

6. The sheet feeding apparatus according to claim 3, wherein the second feeding rotary body has a shaft hole for inserting the elastic shaft in the disc portion.

7. The sheet feeding apparatus according to claim 1, wherein the second feeding rotary body is so supported by a support member that the elastic shaft is rotatable, and wherein the restricting means is formed in a united body with a positioning member for positioning the elastic shaft in an insertion direction of the elastic shaft.

8. The sheet feeding apparatus according to claim 1, wherein the second feeding rotary body is so supported by a support member that the elastic shaft is rotatable, and wherein the support member is formed with, on a side of the second feeding rotary body, a rib-shape wall having a contour extending Outer than a contour in a movable range of the second feeding rotary body.

9. A recording apparatus comprising:

recording means for recording images on a recording medium;

a platen located in facing with the recording means for supporting a recording medium at a recording section; and a feeding apparatus according to any of claims 1 to 8 for feeding the recording medium on a downstream side of the recording means in the feeding direction.

10. The recording apparatus according to claim 9, wherein a support member for rotatively supporting the elastic shaft for the second feeding rotary body is molded in a united body with the platen.

11. A sheet feeding apparatus comprising:

a first feeding rotary body for feeding sheets;

a second feeding rotary body located in facing to the first feeding rotary body for feeding the sheets between the second feeding rotary body and the first feeding rotary body upon pressing the sheets;

an elastic shaft serving as a rotary center of the second feeding rotary body for urging the second feeding rotary body toward the first feeding rotary body;

a support member for supporting the elastic shaft; and restricting means formed on and in a united body with the support member for restricting movements of the second feeding rotary body at least in a sheet thickness direction and in a direction toward an upstream side of the sheet feeding direction when contacting with a part of the second feeding rotary body when the second feeding rotary body moves and allowing movement of a certain distance of the second feeding rotary body when in its normal state and out of contact with the second feeding rotary body.

12. A recording apparatus comprising:

recording means for recording images on sheets;

a platen located in facing with the recording means for supporting the sheets at a recording section;

a first feeding rotary body for feeding the sheets;

a second feeding rotary body located in facing to the first feeding rotary body for feeding the sheets between the second feeding rotary body and the first feeding rotary body upon pressing the sheets;

an elastic shaft serving as a rotary center of the second feeding rotary body for urging the second feeding rotary body toward the first feeding rotary body;

a support member formed in a united body with the platen for supporting the elastic shaft; and restricting means formed on and in a united body with the support member for restricting movements of the second feeding rotary body at least in a sheet thickness direction and in a direction toward an upstream side of the sheet feeding direction when contacting with a part of the second feeding rotary body when the second feeding rotary body moves and allowing movement of a certain distance of the second feeding rotary body when in its normal state and out of contact with the second feeding rotary body.

* * * * *

UNITED STATES PATENT AND TRADEMARK OFFICE

CERTIFICATE OF CORRECTION

PATENT NO. : 6,276,680 B1 
DATED : August 21, 2001
INVENTOR(S) : Shinya Sonoda et al.

It is certified that error appears in the above-identified patent and that said Letters Patent is hereby corrected as shown below:

Column 1,
Line 28, "medium" should read -- medium, --.
Line 39, "time." should read -- Time.¶ Among the above recording apparatuses, the inkjet type recording apparatus (inkjet recording apparatus) is to make a recording in spraying inks onto the recording medium from a recording means (recording head) and has advantageous points such that the recording means can be made compact, that high resolution images can be recorded with high speed, that a plain paper can be recorded without necessity of particular processing, that the running cost can be reduced, that noises become less because of a non-impacting type, and that a color image recording can be made easily using multicolor inks. The line type apparatus using a line type recording means in which many orifices are arrayed in the paper width direction, inter alia, can record with further higher speed. ¶ Particularly, the recording means (recording head) of an inkjet type in spraying inks utilizing thermal energy can be easily manufactured in having a high density liquid passage layout (orifice layout) by forming electrothermal converters, electrodes, liquid passage walls, ceiling plates, and the like, which is made ion a film on a substrate through a semiconductor manufacturing process such as etching, evaporation, sputtering, and the like, thereby rendering the means further compact. The recording means can be easily made in a long shape or a plane shape (two-dimensional) in utilizing advantages of the IC technology and the micro-fabrication technology, so that the recording means can easily be full-multicolored or mounted with high density. --.
Line 48, "having a" should read -- having --.

Column 5,
Line 23, "shown.," should read -- shown, --.

Column 6,
Line 15, "36,and" should read -- 36, and --.
Line 42, "portion 36" should read -- portion 36b --.

UNITED STATES PATENT AND TRADEMARK OFFICE

CERTIFICATE OF CORRECTION

PATENT NO. : 6,276,680 B1
DATED : August 21, 2001
INVENTOR(S) : Shinya Sonoda et al.

It is certified that error appears in the above-identified patent and that said Letters Patent is hereby corrected as shown below:

Column 7,
Line 65, "deliver" should read -- delivery --.

Signed and Sealed this

Eighteenth Day of June, 2002

*Attest:*

*Attesting Officer*

JAMES E. ROGAN
*Director of the United States Patent and Trademark Office*